US008510886B2

(12) United States Patent
Schulze et al.

(10) Patent No.: US 8,510,886 B2
(45) Date of Patent: Aug. 20, 2013

(54) PROCESS FOR ACCELERATED WETTING OF LAUNDRY IN A DRUM WASHING MACHINE

(75) Inventors: Ingo Schulze, Panketal (DE); Gundula Czyzewski, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1806 days.

(21) Appl. No.: 11/044,396

(22) Filed: Jan. 27, 2005

(65) Prior Publication Data

US 2005/0204481 A1 Sep. 22, 2005

Related U.S. Application Data

(63) Continuation of application No. PCT/EP03/06769, filed on Jun. 26, 2003.

(30) Foreign Application Priority Data

Jul. 29, 2002 (DE) ..... 102 34 473

(51) Int. Cl.
*D06F 35/00* (2006.01)

(52) U.S. Cl.
USPC ..... 8/158

(58) Field of Classification Search
USPC ..... 8/158
See application file for complete search history.

(56) References Cited

U.S. PATENT DOCUMENTS

| | | | |
|---|---|---|---|
| 5,606,877 | A | 3/1997 | Hashimoto |
| 5,720,064 | A | 2/1998 | Koo |

FOREIGN PATENT DOCUMENTS

| | | | | |
|---|---|---|---|---|
| DE | 3324481 | A | * | 7/1983 |
| DE | 40 09 046 | C2 | | 9/1991 |
| DE | 41 16 673 | A1 | | 11/1992 |
| DE | 41 38 636 | A1 | | 5/1993 |
| DE | 196 11 089 | A1 | | 9/1997 |
| DE | 197 30 422 | A1 | | 9/1999 |
| EP | 0 318 761 | B1 | | 6/1989 |
| EP | 0373063 | | * | 6/1990 |
| EP | 0 616 068 | B1 | | 9/1994 |
| EP | 0 787 848 | A1 | | 8/1997 |
| GB | 2070648 | | * | 9/1981 |

* cited by examiner

*Primary Examiner* — Michael Kornakov
*Assistant Examiner* — Jason Riggleman
(74) *Attorney, Agent, or Firm* — James E. Howard; Andre Pallapies

(57) ABSTRACT

A method for accelerating the wetting of washing in the variable-speed drum of a drum washing machine. A quantity of fresh water is introduced according to the determined quantity of laundry. The drum is driven at intervals and in a reversing manner in successive phases for a first determined length of time at an rpm which is adapted to the washing. The drum is stopped and/or driven at an rpm adapted to the wetting of the washing for a second pre-determined length of time, such that the water is especially effectively distributed over the washing by means of ladling devices located on the drum. The required quantity of washing liquid for the following washing phase is determined once the drum is driven at intervals and in a reversing manner at an rpm adapted to the washing after the second pre-determined length of time has come to an end.

22 Claims, 2 Drawing Sheets

PROCESS FOR ACCELERATED WETTING OF LAUNDRY IN A DRUM WASHING MACHINE

BACKGROUND OF THE INVENTION

The invention relates to a process for accelerated wetting of laundry in a speed-controlled drum of a program-controlled drum washing machine with a device to determine the volume of the laundry filled into the drum and with an adjustable tap water filling device and a measuring device for the filled in water volume water volume and for the level of the washing liquid as well as with a control unit to influence the course of the movement of the loaded drum.

In one known process, a speed considerably below the speed suitable for washing is reached when turning the drum by drawing mechanisms on the drum jacket, so that the previously filled in dry laundry is moistened in a relatively short time. The familiar process, however, is too rigid and does not consider various absorbing laundry items. Based on this, more water is used in most cases, than would otherwise been required for the current laundry item. In addition, the duration of the wetting phase cannot satisfy with its considerably more than five minutes.

SUMMARY OF THE INVENTION

The invention therefore is based on the function to ensure in an initially described process at the acceleration of the power phase, that sufficient washing liquid is available in every case for subsequent washing and that only so much water is used in relation to the load and the absorbency of the laundry item as is absolutely necessary.

This function is solved by a process of the invention in which the programming section for wetting contains at least three phases, in which the first phase is or will be determined by the tap water relative to the absorbency of the filling quantity, in a subsequent phase after reaching the water volume filled in the soapy water container by which the drum is moved for a determined first phase in a manner through which an even soaking of the laundry item is achieved, and in a last phase in which the drum is stopped and/or moved at a speed suitable to move in a direction for a second preset duration and the quantity of washing liquid necessary for the subsequent washing phase is only determined after the end of the second defined time and is possibly filled and then the drum is powered in intervals and reversing at a speed suitable for washing.

The measures corresponding with the invention have proven to be very suitable after numerous tests. Advantages in the aforementioned criteria of the task have been found in almost all loading versions.

The process according to the invention may be designed favourably by numerous versions as described herein.

For example, it has an especially favourable effect, if a ratio development between the measure of the currently entering water volume and the current soap level is performed to measure the volume of the tap water and if this ratio is set in relation to the gradient of the soap level increase. The soapy water tank in the washing machine will then never be overfilled, because too much water had been filled in for a possibly below average absorbing laundry item at the beginning.

However, the other measures contribute as well to the improvement of the effect according to the function. This also prevents that the washing efficiency is inhibited due to undetermined and undefined filling steps as in the familiar process to measure the washing liquid volume, because the temperature shock and fluctuations of the detergent concentration may affect the smooth process of the washing process. In addition, in most cases, the washing liquid may be heated earlier and more evenly than the current state of technology, because the level of the filled water covering the heaters is reached more quickly.

Furthermore, intelligent control systems can learn data from the completed filling processes to calculate the laundry quantity estimated prior to the beginning of the filling process. Overall this results in a better adjustment of the filling water volume even at higher loading quantities.

The process according to the invention and individual characteristics of the process are described in more detail, based on diagrams illustrated in the drawing.

DETAILED DESCRIPTION OF ILLUSTRATED EMBODIMENTS

Figure 1:
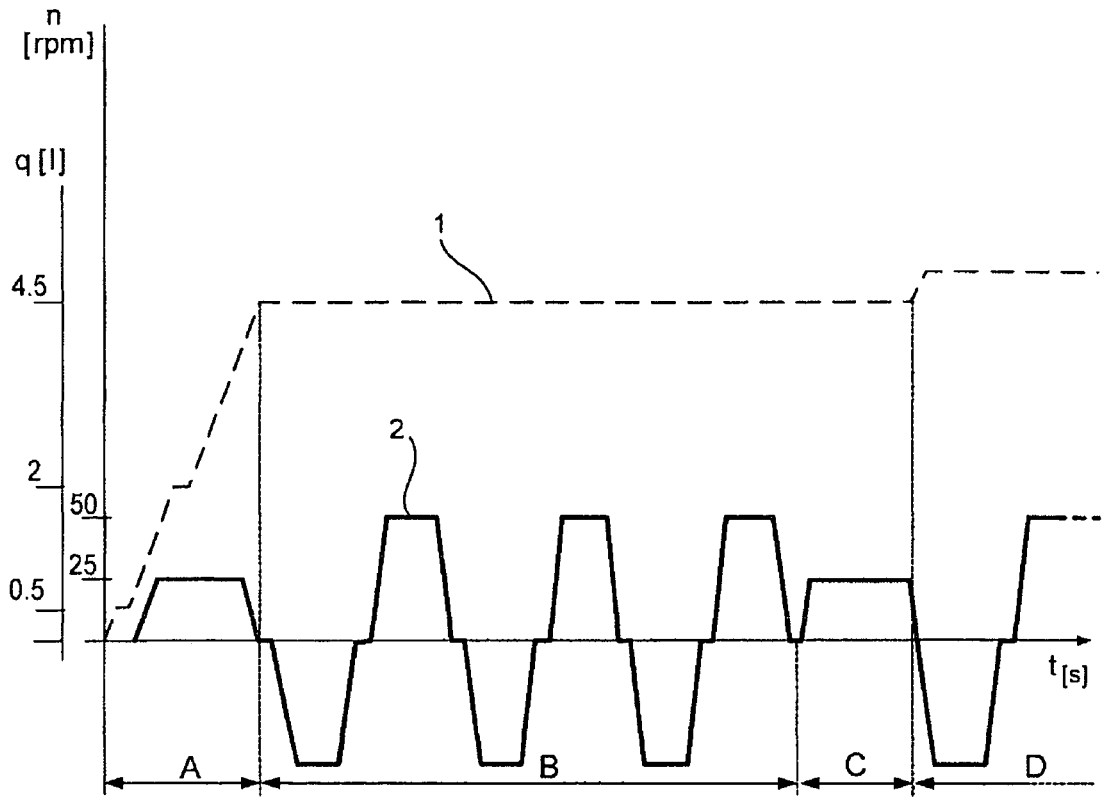
FIG. 1 shows a process of the tap water supply at the beginning of a washing process together with the assigned drum movement phases.

Tap water is filled into the soapy water tank in three phases at the beginning of a washing process in the process according to the invention; 0.5 liters initially, then 1.5 liters and finally approximately 2.5 liters. This is clarified in FIG. 1 by the broken diagram line 1 for volume q of the filled water. The drum movement is illustrated based on speed levels n (in rpm) in the same diagram by the solid diagram line 2. The first phase A, in which the streaming water volume is constantly measured, lasts about two minutes and is identified by rapidly filling with tap water and by a drum slowly turning in one direction at approximately 25 rpm.

The ratio of the measured values of the soapy water volume and the soapy water level or their difference contains a reference to the suction capacity of the laundry item. Together with the value for the gradient of the soapy water level increase during the rotation of the laundry drum, the value for the laundry item or for its overall suction capacity and therefore also the volume for the initial fill of tap water may therefore be calculated relatively accurately from these measured values. A predetermined quantity may have been defined for the initial fill instead of the calculation, which is oriented to a minimum suction capability of a laundry item that is to be treated.

As soon as the third partial quantity of tap water is filled in, the drum begins to turn at about 50 rpm approximately three times in intervals and reversing during phase B. This phase serves to intensify the soaking of the laundry, which is expressed in the decreasing soap level over the duration of phase B.

Other measures may be used to intensify the soaking process instead or in addition to these actions. The gradient of these soap level decreases again leads to a conclusion to the laundry quantity, whereby the accuracy of the value estimated during the initial phase A can be essentially improved. The measured value of the current soapy water level furthermore provides the potential to determine the washing method by the absorption capacity when comparing with the total of the entered water volume.

Phase B lasts about three minutes and ends with the transition of the drum movement from the reversing operation into the continuous operation, however, at only approximately 25 rpm. One or more drum-stopping phases may still be within the transition. During this last phase, the quiet phase C, any level control of the washing liquid will be prevented. The laundry has time during phase C to continue to fill with water, in a way, water for absorption. The surface fibre wetting initially penetrates deeper into the fibres. The rotating direction of the drum may be advantageously selected as that during which the water is distributed especially effectively over the laundry by the drawing mechanisms of the drum.

Phase C continues for approximately one half minute, however, is very important despite its brevity, because it prevents the cutting in of an additional later filling process, if the absorption process has been delayed.

Meanwhile, the control from the measurements of the incoming water volume and the soapy water level has gained so much data from the process of the suction processes that a particular volume for a final tap water addition has been calculated, which rarely is greater than 0.5 liters. The necessary and just sufficient volume of the total required washing liquid is actually defined so precise during this last fill-up that the following washing process (phase D) is not disturbed by any further cold tap water additions while the drum is again turned at 50 rpm in intervals and reversing. The drum may again be stopped before or during the final tap water addition for one or more brief times.

Figure 3:
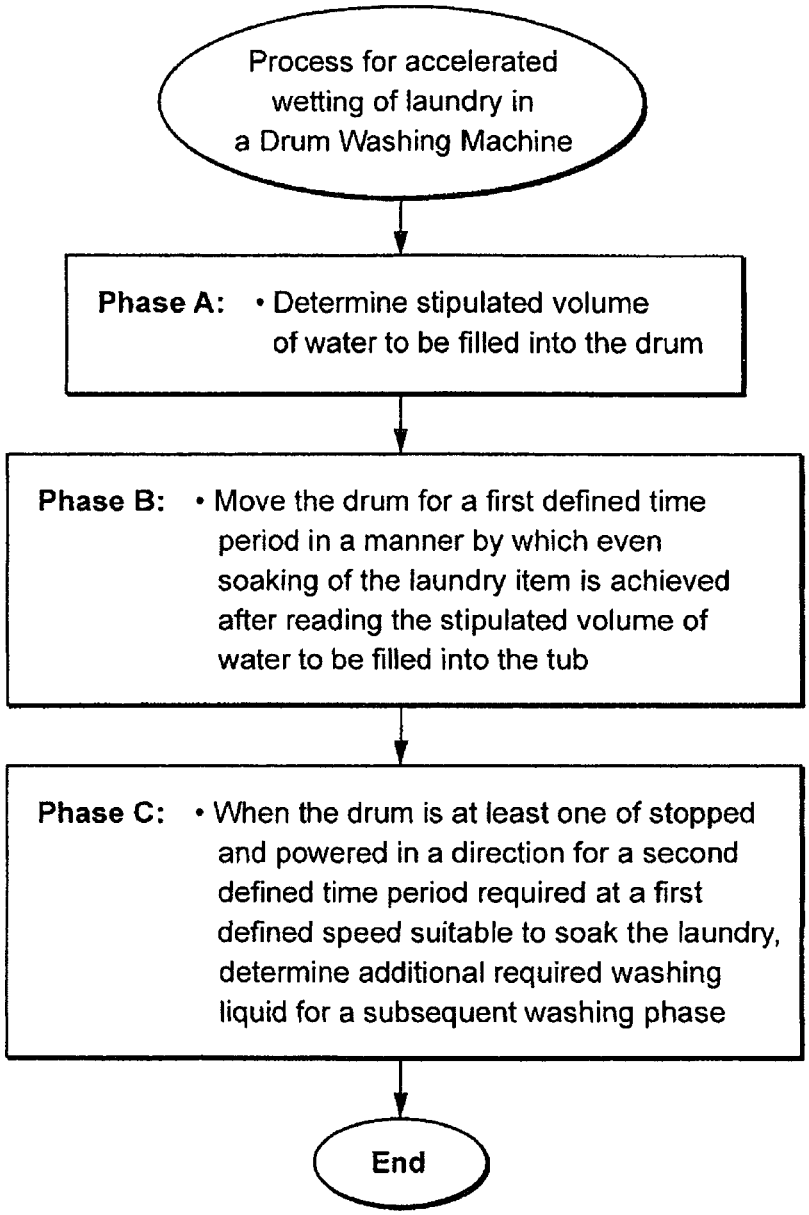
FIG. 3 shows a block diagram of a sample process according to the present invention.

FIG. 3 shows a block diagram illustrating the method described above.

Figure 2:
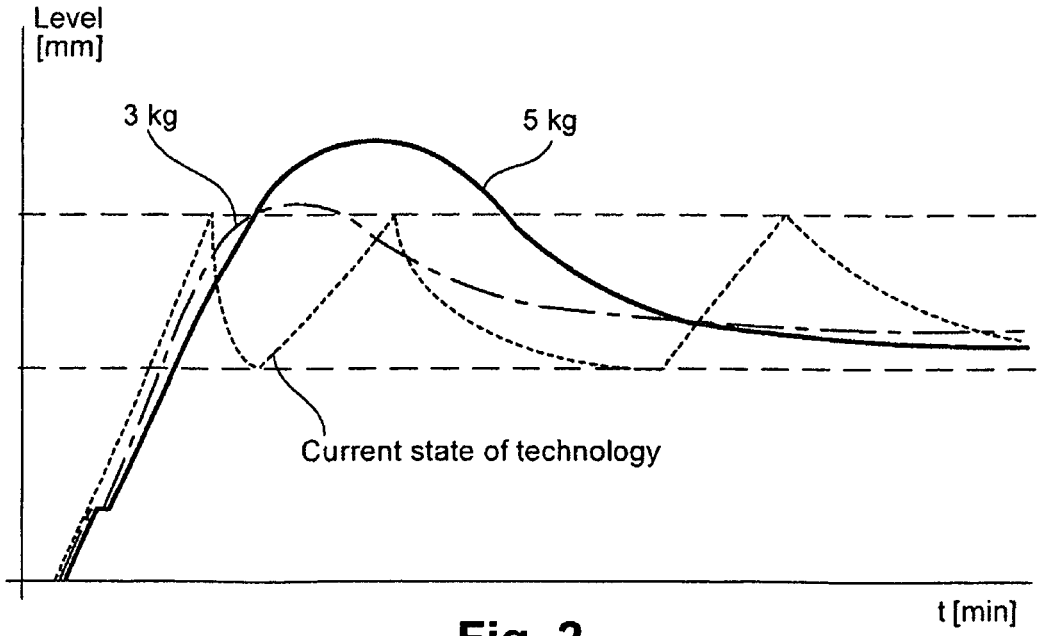
FIG. 2 shows a comparison of the processes of the invented process with two different loads in a comparison to the rigid but still undetermined process according to the current state of technology.

The comparison of the process according to the invention with a process from the current state of technology in FIG. 2 shows only the level characteristics for the soapy water tank fill-up for the sake of simplicity. The horizontal dotted lines show the upper and lower switching point of the level control. The medium thick dotted or the thick continuous line shows the appropriate level characteristic for a load of 3 kg or 5 kg of dry laundry and the filling process according to the invention. The thin dotted line, however, shows the level line during a filling process according to the state of technology, whereby different loading quantities are only expressed in the number of tank refilling processes. The advantage of the invented process is clearly recognisable from this comparison. The filling process with washing liquid required for washing is completed much sooner than with the current state of technology. The actual washing process, which begins when reaching the required level and the required temperature, may currently begin much sooner and is also free from the additional cold water fill-up and the therefore connected temperature drop.

The invention claimed is:

1. A process for an accelerated wetting of laundry in a speed-controlled drum of a program-controlled drum washing machine with a tub wherein said drum is rotatably disposed, with a measuring mechanism to determine a quantity of the laundry filled into the drum and with a controllable water filling device and a measuring device to determine a volume of incoming tap water (q) and for a level of the washing liquid in the tub formed of water and other substances, as well as with a control unit to affect the course of the movements of the loaded drum, the process comprising the following acts:

performing a first phase (A) in which a stipulated volume of water to be filled into the tub is determined, the determination of the stipulated volume of water to be filled into the tub including characterizing an absorption capacity of the laundry by evaluating a ratio between the volume of incoming tap water (q) and the level of the washing liquid in the tub and thereafter stipulating the stipulated volume of water to be filled into the tub as a function of the absorption capacity of the laundry;

performing a second phase (B) in which the drum is moved for a first defined time period in a manner by which the even soaking of the laundry item is achieved after reaching the stipulated volume of water to be filled into the tub;

performing a final phase (C) during which the drum is at least one of stopped and powered in a direction for a second defined time period required at a first defined speed suitable to soak the laundry during the final phase (C), and the washing liquid required for the subsequent washing phase (D) is only defined and filled up after the end of the second defined time period; and performing a washing phase (D) in which the drum is powered at a second defined speed suitable for washing in intervals and reversing of direction.

2. The process as claimed in claim 1, wherein the first defined time is approximately 3 minutes.

3. The process as claimed in claim 1, wherein the second defined time is approximately 30 seconds.

4. The process as claimed in claim 1, wherein the first defined speed is approximately 25 rpm.

5. The process as claimed in claim 1, wherein the second defined speed is approximately 50 rpm.

6. The process as claimed in claim 1, wherein tap water is added into the tub in a plurality of discrete phases during each of which a predetermined quantity of tap water is added into the tub and the plurality of discrete phases includes at least two phases.

7. The process as claimed in claim 1, further comprising performing a ratio calculation between the measure of the current level of the washing liquid to measure the volume (q) of the water to be filled in and applying this ratio relative to the gradient of the increase of the washing liquid in the tub, wherein the ratio calculation takes into account deviations from a cylindrical shape of the drum.

8. The process as claimed in claim 1, wherein laundry in the drum includes laundry items that collectively have a capacity to absorb water and the stipulated volume of water to be filled into the tub is adjusted as a function of an evaluation of a capacity of the laundry items in the drum to absorb water.

9. The process as claimed in claim 1, wherein the drum is powered in the second phase (B) in intervals and reversing of direction at a third defined speed suitable for washing.

10. The process as claimed in claim 9, wherein the third defined speed is approximately 50 rpm.

11. The process as claimed in claim 1, wherein the drum rotating direction is selected during the final phase (C), in which the washing liquid is distributed especially effectively over the laundry by a water distribution structure in the drum.

12. The process as claimed in claim 1, further comprising determining the first defined time period of phase (B) in response to a gradient limit value of the decline of the level of the washing liquid in the tub during phase (B).

13. The process as claimed in claim 12, wherein the first defined time period of phase (B) allows three reversing cycles for the drum movement.

14. The process as claimed in claim 13, wherein the second defined time is less than 1 minute.

15. The process as claimed in claim 1, wherein at least one of the duration of the final phase (C) and the quantity of drum movement of the final phase (C) is determined in response to the absorption capability of the laundry item filled into the drum.

16. The process as claimed in claim 1, wherein a volume of washing liquid required for the washing phase (D) which follows the final phase (C) is completed by a single defined amount of water added to the washing liquid in the drum at the beginning of the washing phase (D).

17. The process as claimed in claim 1, further comprising moving the drum at a third defined speed during the initial water supply (phase A), at which the effect of water distribution structures of a drum jacket of the drum is especially great.

18. The process as claimed in claim 17, wherein the third defined speed is approximately 25 rpm.

19. A process for an accelerated wetting of laundry in washing machine having a control unit, a tub, a drum being disposed in the tub and movable with respect to the tub and in response to signals from the control unit, a measuring mechanism to determine the quantity of the laundry filled into the drum and to provide signals to the control unit, a controllable tap water filling device, a measuring device for the filled water volume (q) and for the level of the washing liquid and providing signals to the control unit, the process comprising the acts of:

filling an amount of water into the tub;

driving the drum for a first defined time period to evenly soak the laundry;

performing an action on the drum for a second defined time period to soak the laundry, including a t least one of stopping the drum and driving the drum in a direction at a first defined speed;

defining a required amount of washing liquid in response to the completion of the second defined time period;

actuating a subsequent washing phase in which the washing liquid required for the washing phase is only defined after the end of the second defined time period and is filled up, if necessary, and driving the drum at a second defined speed suitable for washing in intervals and reversing the direction of movement of the drum, and determining the first defined time period in response to a gradient limit value of a decline of the level of the washing liquid.

20. The process as claimed in claim 19, wherein the act of driving the drum for a first defined time period includes three reversing cycles for the drum movement.

21. The process as claimed in claim 20, wherein the second defined time is less than 1 minute.

22. A process for an accelerated wetting of laundry in washing machine having a control unit, a tub, a drum being disposed in the tub and movable with respect to the tub and in response to signals from the control unit, a measuring mechanism to determine the quantity of the laundry filled into the drum and to provide signals to the control unit, a controllable tap water filling device, a measuring device for the filled water volume (q) and for the level of the washing liquid and providing signals to the control unit, the process comprising the acts of:

filling an amount of water into the tub;

driving the drum for a first defined time period to evenly soak the laundry;

performing an action on the drum for a second defined time period to soak the laundry, including at least one of stopping the drum and driving the drum in a direction at a first defined speed;

defining a required amount of washing liquid in response to the completion of the second defined time period;

actuating a subsequent washing phase in which the washing liquid required for the washing phase is only defined after the end of the second defined time period and is filled up, if necessary, and driving the drum at a second defined speed suitable for washing in intervals and reversing the direction of movement of the drum, and determining the second defined time period in response to the absorption capability of the laundry item filled into the drum.

* * * * *